US005712004A

United States Patent [19]

Lin

[11] Patent Number: 5,712,004

[45] Date of Patent: Jan. 27, 1998

[54] CONTAINER WITH ORNAMENTAL OUTER SWIVELS

[75] Inventor: Rick Lin, Tainan, Taiwan

[73] Assignee: Juei Chyuan Enterprise Co., Ltd., Tainan, Taiwan

[21] Appl. No.: 587,499

[22] Filed: Jan. 17, 1996

[51] Int. Cl.[6] ..... B32B 1/02

[52] U.S. Cl. ..... 428/33; 428/34.1; 446/71; 446/321

[58] Field of Search ..... 446/71, 321; 428/66.6, 428/34.1, 7, 33

*Primary Examiner*—Alexander Thomas

*Attorney, Agent, or Firm*—Morton J. Rosenberg; David I. Klein

[57] ABSTRACT

A container having ornamental outer swivels is provided which comprises a main body, a plurality of outer swivels and a bottom ringed element. The outer circumferential surfaces of an outer annular lip of the main body, of each outer swivel and of the bottom ringed element each have indicia formed thereon that defines a portion of an ornamental design. A plurality of elongate holes are formed in upper ends of the walls of the outer swivels and of the bottom ringed element, respectively. A plurality of bead holes are formed in the bottom of the outer annular lip of the main body, and the bottom end of the walls of the outer swivels, respectively. A plurality of steel beads and springs are provided and disposed inside the elongate holes so that the steel beads can snap onto the bead holes by means of the bias force of the springs, so that the aligned outer swivels will not be easily displaced by external force.

1 Claim, 4 Drawing Sheets

CONTAINER WITH ORNAMENTAL OUTER SWIVELS

BACKGROUND OF THE INVENTION

A heretofore known container with swivel rings, as shown in FIG. 6, is provided which comprises a main body 11, a plurality of swivel rings 12 and a bottom ring 13.

The main body 11 includes an annular lip 112 on the upper portion thereof and a cavity 111 formed therein.

The bottom ring 13 has an inner rim 131 at the bottom end thereof.

In assembling the container with swivel rings, the plurality of the swivel rings 12 are inserted on the main body 11. The swivel rings 12 are blocked by and under the annular lip 112, and then the bottom ring 13 is connected with the bottom portion of the main body 11.

Furthermore, the outer circumferential surfaces of the annular lip 112, of each swivel ring 12 and of the bottom ring 13 each assumes a portion of a design which can be matched by a user swiveling the swivel rings 12 to a proper position.

The container with swivel rings as described above has an ornamental and entertaining effect. However, the swivel rings 12 are prone to swivel when touched, and thereby get unmatched easily, such that the ornamental effect thereof is reduced.

SUMMARY OF THE INVENTION

The present invention relates to a container with ornamental outer swivels which comprises a main body having an outer annular lip, a plurality of outer swivels and a bottom ringed element.

The outer circumferential surface of the outer annular lip on the main body, of each outer swivel, and of the bottom ringed element, each assumes a respective portion of a design. The design can be matched by a user by rotating the outer swivels to a proper position.

Furthermore, a plurality of elongate holes are bored in the top end of walls of the outer swivels and the bottom ringed element, respectively. A plurality of bead holes are bored in the bottom of the outer annular lip and of the bottom end of the walls of the outer swivels, respectively. A plurality of steel beads and springs are provided to be fitted inside the elongate holes. Thus, the steel beads can snap onto the bead holes by means of the bias of the springs, as long as the design is matched by a user rotating the outer swivels, and the design once matched, won't inadvertently become unmatched, easily, by an external force. Therefore, the decorating effect thereof is secured.

BRIEF DESCRIPTION OF DRAWINGS

The invention will be better understood by reference to the accompanying drawings, wherein.

DESCRIPTION OF THE PREFERRED EMBODIMENTS

Figure 1:
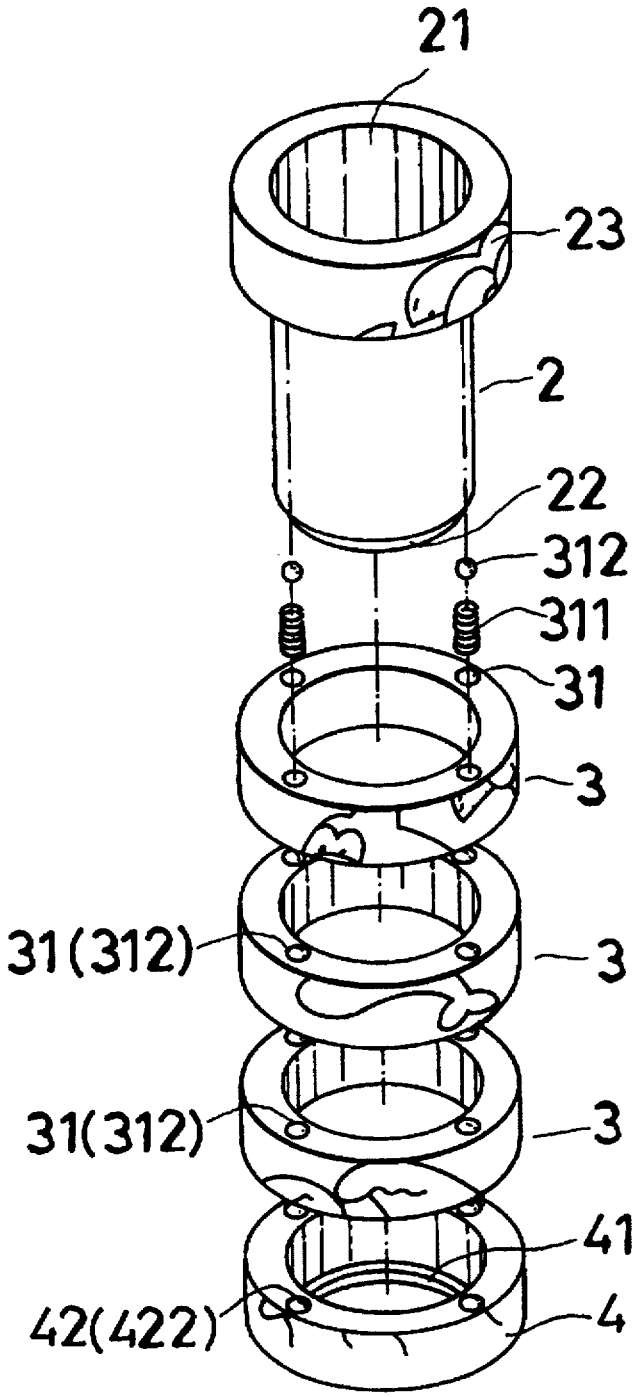
FIG. 1 is an exploded view of a container with ornamental outer swivels of the present invention.
Figure 2:
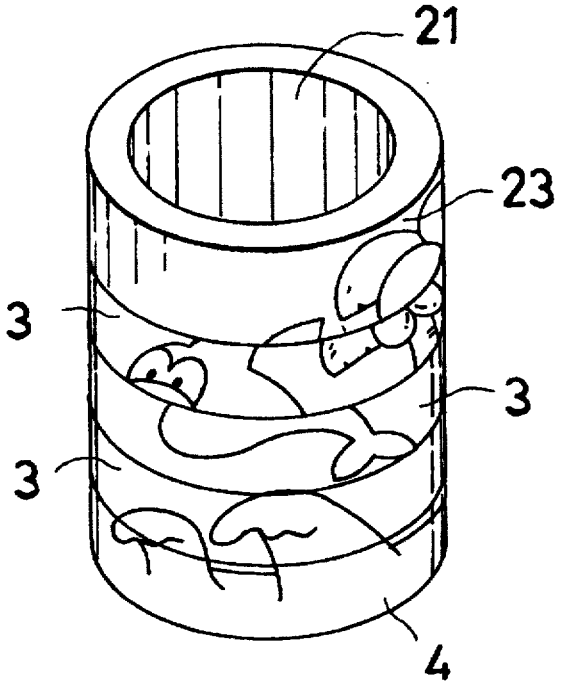
FIG. 2 is a perspective view of the container of the present invention with ornamental outer swivels, as shown in FIG. 1, after assembly.
Figure 3:
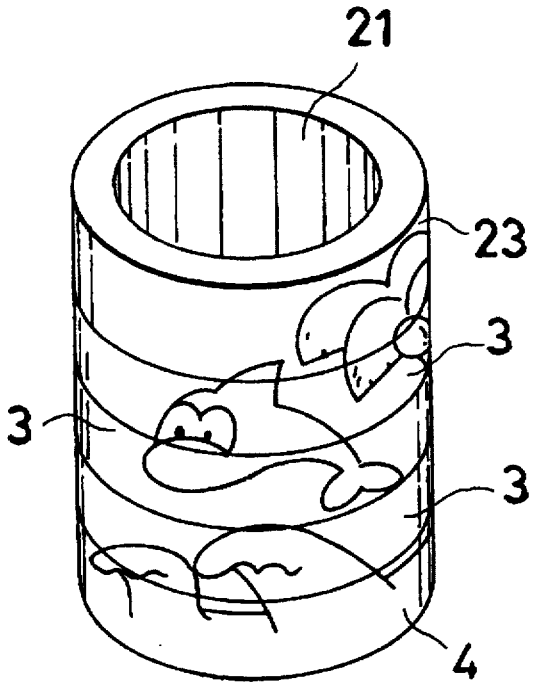
FIG. 3 is a perspective view of the container of the present invention with ornamental outer swivels, as shown in FIG. 2, after all portions of a design thereon have been matched with one another.
Figure 5:
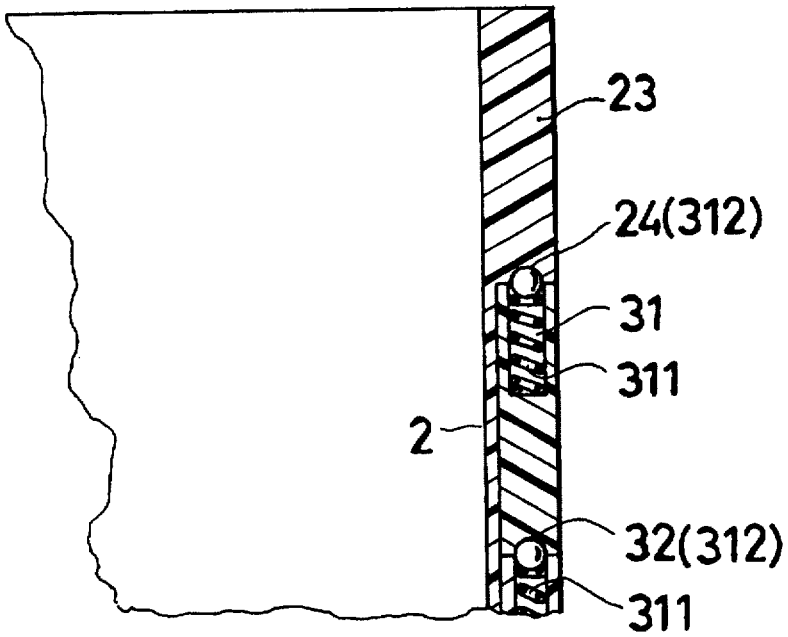
FIG. 5 is a magnified view of a portion of FIG. 4.
Figure 4:
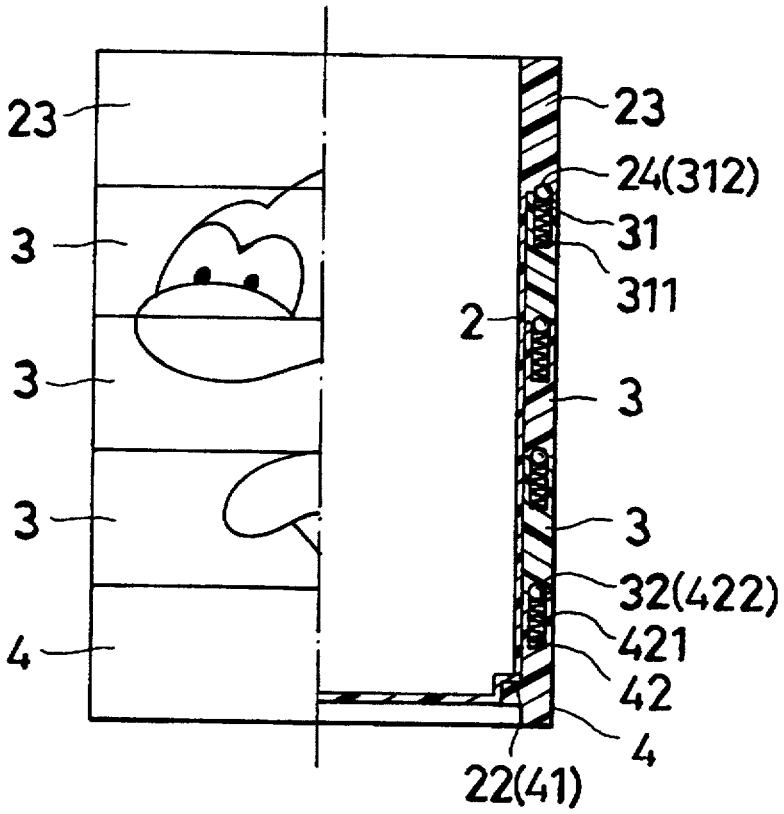
FIG. 4 is a cross-sectional view of a fragment of the container with ornamental outer swivels as shown in FIG. 3.
Figure 6:
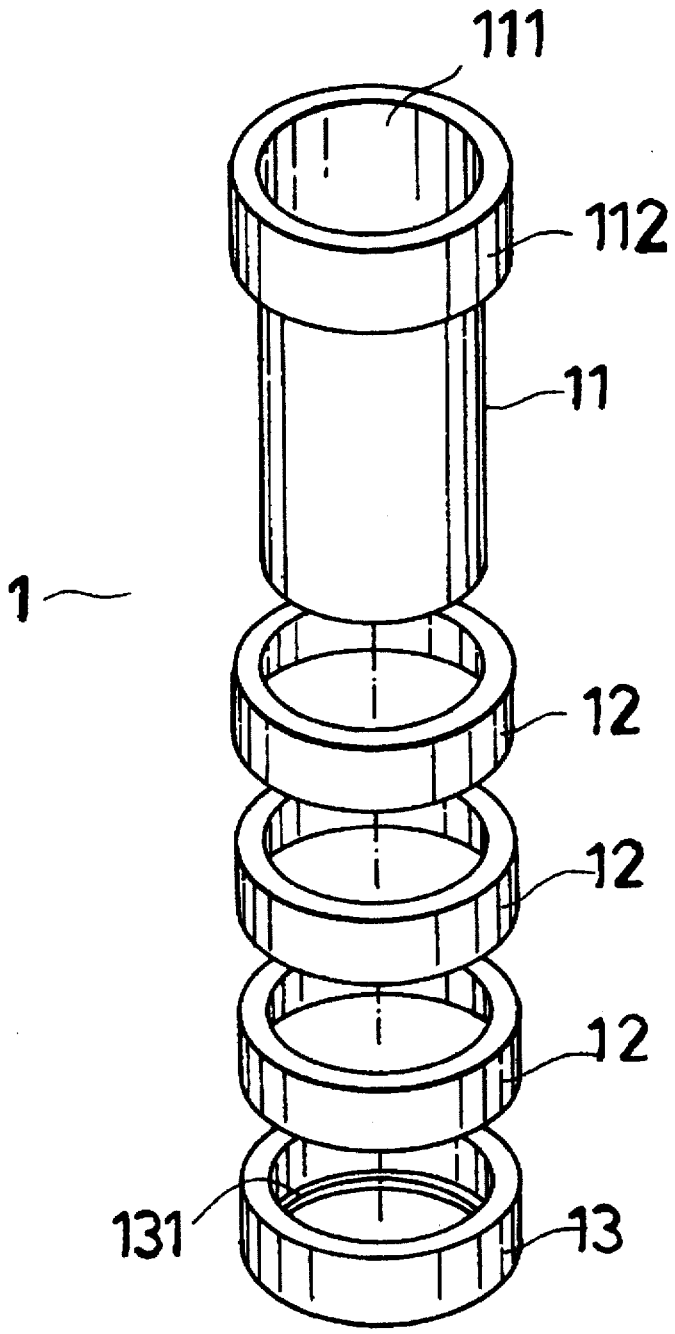
FIG.6 (PRIOR ART)
FIG. 6 is an exploded view of a prior art container with swivel rings.

A container having ornamental outer swivels, as shown in FIGS. 1–5, is provided with a main body 2, a plurality of outer swivels 3 and bottom ringed element 4.

The main body is shaped as a hollow cylinder and has a cavity 21, an outer annular lip 23 on the upper portion thereof, a bottom recessed portion 22 on the bottom portion thereof, and a plurality of bead holes 24 formed in a bottom edge of the outer annular lip 23.

Each outer swivel 3 is shaped as a ring and has a plurality of elongate holes 31 formed vertically in an upper end of a wall thereof. The elongate holes 31 extend a predetermined distance downward. A plurality of bead holes 32 are formed in a bottom end of the wall of each outer swivel 3.

The bottom ringed element 4 includes a plurality of elongate holes 42 formed vertically in an upper end of a wall thereof. The elongate holes 42 extend a predetermined distance downward. The bottom ringed element 4 also has an internal rim 41 formed on the bottom portion thereof.

Furthermore, indicia is applied to the outer circumferential surface of each outer swivel 3, of the outer annular lip 23 of the main body 2, and of the bottom ringed element 4. The indicia on each of those elements defines a portion of a complete design. A plurality of springs 311, 421 and steel beads 312, 422 are also provided. The springs 311 are disposed inside the elongate holes 31, the steel beads 312 being positioned above the springs 311, respectively. The springs 421 are disposed inside the elongate holes 42 of the bottom ringed element 4, the steel beads 422 being positioned above the springs 421, respectively.

In assembling the container with ornamental outer swivels of the present invention, the plurality of outer swivels 3 are inserted on the main body 2 and then the bottom ringed element 4 is connected with a bottom portion of the main body 2. The outer swivels 3 are arranged in sequence, according to the ornamental design that is formed by the indicia on the outer circumferential surface of each outer swivel 3. A high frequency bonding method is used for joining the internal rim 41 of the bottom ringed element with the bottom recessed portion 22 of the main body 2. The springs 311 and steel beads 312 are positioned inside each elongate hole 31 of the outer swivel 3 and the springs 421 and steel beads 422 are positioned inside each of the elongate holes 42 of the bottom ringed element 4 prior to the joining of internal rim 41 with the recessed portion 22.

After the container with ornamental outer swivels is assembled, a user can rotate the outer swivels 3 thereof, so that all portions of the design are made to match with one another. Meanwhile, the steel beads 312, 422 snap onto the respective bead holes 24, 32 by means of the bias force of the springs 311, 421. Thus, all portions of the design that have been matched won't easily be displaced by an external force acting on the container or inadvertently through use of the container.

From the above description of the container with ornamental outer swivels 3, it can be understood that an advantage thereof is that the springs 311, 421, the steel beads 312, 422, the elongate holes 31, 42 and the bead holes 24, 32 provided therein can prevent ornamental design of the matched indicia from easily becoming unmatched.

While the preferred embodiments of the invention have been described above, it will be recognized and understood that various modifications may be made therein and the appended claims are intended to cover all such modifications which may fall within the spirit and scope of the invention.

What is claimed is:

1. A container having ornamental swivels, comprising:

a hollow main body open on one end thereof, said main body having an outer annular lip formed adjacent said open end and an annular recess formed in an opposing end thereof, said outer annular lip having a bottom edge with a plurality of bead holes formed therein and an outer circumferential surface with a first indicia pattern formed thereon;

a bottom ringed element coupled to said main body, said bottom ringed element having an annular wall with a rim formed on an internal edge thereof adjacent a bottom end of said bottom ringed element, said rim being joined to said annular recess of said main body, said bottom ringed element having an upper end with a plurality of elongated holes formed therein and an outer circumferential surface with a second indicia pattern formed thereon;

a plurality of outer swivels rotatably disposed on said main body intermediate said annular lip and said bottom ringed element, each of said plurality of outer swivels being formed by an annular wall having an upper end with a plurality of elongated holes formed therein and a bottom end with a plurality of bead holes formed therein, each of said plurality of outer swivels having an outer circumferential surface with a third indicia pattern formed thereon;

a plurality of springs disposed in said plurality of elongated holes of said bottom ringed element and each of said plurality of outer swivels; and, a plurality of bead members, each of said plurality of bead members being disposed at least partially in a respective one of said plurality of elongated holes of said bottom ringed element and each of said plurality of outer swivels on a respective one of said plurality of springs, wherein said plurality of bead members respectively engage said plurality of bead holes of said annular lip and said plurality of outer swivels when said third indicia patterns are aligned with said first and second indicia patterns to form a predetermined ornamental design, said engagement of said bead members with said bead holes providing a resistance to rotative displacement of said plurality of outer swivels relative to said main body.

* * * * *